US007306031B2

(12) United States Patent
Wright et al.

(10) Patent No.: US 7,306,031 B2
(45) Date of Patent: Dec. 11, 2007

(54) TUBING STRING ROTATOR AND METHOD

(75) Inventors: Andrew J. Wright, Leduc (CA); James Bentley, Beaumont (CA)

(73) Assignee: GADU, Inc., Bridgetown (BB)

( * ) Notice: Subject to any disclaimer, the term of this patent is extended or adjusted under 35 U.S.C. 154(b) by 316 days.

(21) Appl. No.: 10/891,113

(22) Filed: Jul. 15, 2004

(65) Prior Publication Data

US 2006/0011339 A1 Jan. 19, 2006

(51) Int. Cl.
*E21B 43/12* (2006.01)

(52) U.S. Cl. ..... 166/68.5; 166/78.1; 166/105; 175/107

(58) Field of Classification Search ..... 166/68.5, 166/78.1, 105; 175/107; 192/3.57, 12 C, 192/18 A, 46, 69.81; 464/21
See application file for complete search history.

(56) References Cited

U.S. PATENT DOCUMENTS

| | | | |
|---|---|---|---|
| 1,662,984 | A | 3/1928 | Scott |
| 2,294,061 | A | 8/1942 | Williamson |
| 2,471,198 | A | 5/1949 | Cormany |
| 2,595,434 | A | 5/1952 | Williams |
| 2,630,181 | A | 3/1953 | Solum |
| 4,293,060 | A | 10/1981 | Miller |
| 4,716,961 | A | 1/1988 | Makins |
| 4,750,559 | A | 6/1988 | Greenlee |
| 4,883,121 | A | 11/1989 | Zwart |
| 5,139,090 | A | 8/1992 | Land |
| 5,197,546 | A | 3/1993 | Murray |
| 5,327,975 | A | 7/1994 | Land |
| 5,383,519 | A | 1/1995 | Wright |
| 5,388,639 | A | 2/1995 | Betchan |
| 5,427,178 | A | 6/1995 | Bland |
| 5,429,188 | A | 7/1995 | Cameron |
| 5,431,230 | A | 7/1995 | Land |
| 5,551,510 | A | 9/1996 | Mills |
| 5,636,690 | A | 6/1997 | Garay |
| 5,732,777 | A | 3/1998 | Grimshaw |
| 5,829,531 | A | 11/1998 | Hebert |
| 5,964,286 | A | 10/1999 | Cuppen |
| 6,026,898 | A | 2/2000 | Bland |

(Continued)

FOREIGN PATENT DOCUMENTS

| | | |
|---|---|---|
| CA | 2278059 | 1/2001 |

(Continued)

*Primary Examiner*—Lanna Mai
*Assistant Examiner*—Matthew J. Smith
(74) *Attorney, Agent, or Firm*—Merek, Blackmon & Voorhees, LLC

(57) ABSTRACT

A tubing string rotator for rotating a tubing string in a well having a downhole pump. The tubing string rotator includes a housing having a first portion and a second portion. At least the second portion of the housing is adapted to be operatively connected to the end of a length of the tubing string such that rotational torque applied to the tubing string through the operation of the pump is transferred to the second portion of the housing. The rotator further includes means to permit the controlled rotation of the second portion, together with the tubing string connected thereto, relative to the first portion of the housing when the ability of the first portion to rotate is retarded or eliminated, and when rotational torque is supplied to the tubing string through the operation of the pump.

29 Claims, 13 Drawing Sheets

U.S. PATENT DOCUMENTS

| | | | | |
|---|---|---|---|---|
| 6,039,115 | A | 3/2000 | Mills | |
| 6,062,309 | A | 5/2000 | Gosse | |
| 6,073,693 | A | 6/2000 | Aldridge | |
| 6,125,931 | A | 10/2000 | Hult | |
| 6,199,630 | B1 | 3/2001 | Blundell | |
| 6,289,986 | B1 | 9/2001 | Wright | |
| 6,543,533 | B2 | 4/2003 | Meek | |
| 6,557,639 | B1 * | 5/2003 | Matthews et al. | 166/105 |
| 6,640,892 | B1 | 11/2003 | Wright | |
| 2003/0024709 | A1 | 2/2003 | Cuppen | |

FOREIGN PATENT DOCUMENTS

| | | |
|---|---|---|
| JP | 63251520 | 10/1988 |

* cited by examiner

TUBING STRING ROTATOR AND METHOD

FIELD OF THE INVENTION

This invention relates to an apparatus that may be used to rotate a tubing string within an oil or water well, and in particular to such an apparatus that operates without the need for dedicated motors or other specifically dedicated sources of mechanical energy that are exterior to the well.

BACKGROUND OF THE INVENTION

When pumping oil (or for that matter water or other fluids) from wells driven into the ground, a downhole pump is often utilized wherein the pump is physically located deep within the well to pump the oil or fluid to the surface. In many such applications the downhole pump of choice is a screw or progressive cavity pump. Screw or progressive cavity pumps generally operate through the revolution of a pump rotor within a stationary housing or stator. In most instances a rotating pump rod extends from the surface down through the well to the pump to drive the rotor. A power supply, which would typically be comprised of a gas or diesel engine, or an electric motor, provides the mechanism by which the pump rod, and hence the pump rotor, is rotated.

In most oil and water well applications a production tubing string is positioned within the well casing about the pump rod and is connected to the pump to provide a conduit for the extraction of oil or fluids from the well. Commonly the upper end of the production tubing string is held within the well casing through the use of a variety of flanges, hangers (often referred to as dognuts) or similar devices. The bottom end of the tubing string is often secured to the casing by means of an anchor or no-turn tool. With the rotation of the rotor in a downhole progressive cavity pump there is a tendency to impart what in many cases is a very significant torque to the production tubing string.

Accordingly, a swivel is typically inserted within the production tubing string to prevent torque from being carried throughout the length of the string to the surface of the well.

It has been found that during production the type and quantities of fluids passing through the tubing string, as well as instances where the rotating pump rod comes into contact with the interior surface of the tubing string, can cause wear and erosion of the surface of the string. The degree of wear and erosion can increase significantly in deep wells, or in wells that are not perfectly vertical in orientation where the rod often contacts the string over a great distance. It is well know that through rotating the tubing string in a slow and constant manner, the wear that typically incurs on its inside surface can be more evenly distributed about the string, thereby significantly extending the tubing string's life and reducing the potential for equipment failure and the resulting and associated costs and lost production.

A variety of devices have been proposed by others to present a means to rotate the tubing string in order to more evenly distribute wear about the interior surface of the string. Commonly, such devices are mechanically operated tubing string rotators that comprise a housing that is bolted or otherwise attached to the wellhead. Through a mechanical linkage or gear system, an electric motor, a hydraulic motor, or other form of mechanical power source causes the tubing string rotator to slowly rotate the string within the casing. Such known tubing string rotators are described in U.S. Pat. Nos. 2,630,181, dated Mar. 3, 1953; 5,139,090, dated Aug. 18, 1992; 5,383,519, dated Jan. 24, 1995; 5,427,178, dated Jun. 27, 1995; 5,964,286, dated Oct. 12, 1999; and, 6,199,630, dated Mar. 13, 2001.

While existing tubing string rotators have been relatively effective in imparting a rotational movement to a tubing string in the manner described above, they also suffer from a number of limitations that affect their performance, reliability and cost. Not the least of these limitations stems from the fact that existing rotators rely upon a dedicated source of mechanical power to rotate the string. In the majority of applications a dedicated electric or hydraulic motor is mechanically connected to the rotator through a gear reduction system. In other applications a mechanical linkage may be utilized to transfer energy from an alternate wellhead source to cause rotation of the tubing string. In either case, the mode of imparting mechanical energy to the tubing string rotator adds to the physical complexity of the wellhead equipment, increases capital cost, presents a further opportunity for equipment failure (particularly where an electric motor is used) and can add significantly to energy consumption and operating costs.

SUMMARY OF THE INVENTION

The invention therefore provides a tubing string rotator that alleviates many of the problems associated with existing rotators through the provision of a mechanism that does not rely upon a traditional external power source. Rather, the present invention provides a tubing string rotator that harnesses the torque that is applied, either directly or indirectly, to the tubing string through the operation of a downhole pump.

Accordingly, in one of its aspects the invention provides a tubing string rotator for rotating a tubing string in a well having a downhole pump, the tubing string rotator comprising a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, means to permit the controlled rotation of said second portion of said housing, together with the tubing string connected thereto, relative to said first portion of said housing when the ability of said first portion to rotate is retarded or eliminated, and when rotational torque is supplied to the tubing string through the operation of the pump.

The invention also concerns a tubing string rotator for rotating a tubing string in a well having a downhole pump, the tubing string rotator comprising a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, a hydraulic, mechanical or frictional brake to permit the controlled rotation of said second portion of said housing, together with the tubing string connected thereto, relative to said first portion of said housing when the ability of said first portion to rotate is retarded or eliminated, and when rotational torque is supplied to the tubing string through the operation of the pump.

In a further aspect the invention relates to a tubing string rotator for rotating a tubing string in a well having a downhole pump, the tubing string rotator comprising a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, braking means to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, said braking means including one or more pistons and one or more biasing means, said pistons received within one of said first and said second portions of said housing and said biasing means causing said pistons to engage one or more cammed surfaces on the other of said first and said second portions of said housing such that the interaction of said one or more pistons with said one or more cammed surfaces permits a controlled rotational movement of said second portion of said housing relative to said first portion of said housing.

The invention also concerns a tubing string rotator for rotating a tubing string in a well having a downhole pump, the tubing string rotator comprising a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, braking means to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, said braking means including one or more pistons and one or more hydraulic cylinders received within at least one of said first and second portions of said housing, said pistons received within said hydraulic cylinders and engaging one or more cammed surfaces on one of said first and said second portions of said housing such that the interaction of said one or more pistons with said one or more cammed surfaces permits a controlled rotational movement of said second portion of said housing relative to said first portion of said housing upon operation of the pump, said one or more hydraulic cylinders comprising one or more fluid filled cylinders connected to a fluid reservoir by way of one or more orifices, said one or more orifices permitting the controlled and retarded flow of fluid between said reservoir and said one or more cylinders to permit movement of said one or more pistons relative to said one or more cammed surfaces in a controlled manner.

The invention also pertains to a tubing string rotator for rotating a tubing string in a well having a downhole pump, the tubing string rotator comprising a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, braking means to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, said braking means including a bull gear operatively connected to said second portion of said housing and a torque limiter operatively connected to said bull gear, said torque limiter controlling the rotational movement of said bull gear and thereby controlling the rate of rotation of said tubing string.

In still a further aspect the invention concerns a tubing string rotator for rotating a tubing string in a well having a downhole pump, the tubing string rotator comprising a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, one or more gears operatively connected to said second portion of said housing to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, the rate of rotation of said second portion of said housing controlled through the operation of said one or more gears.

An alternate embodiment of the invention encompasses a tubing string rotator for permitting the rotation of a tubing string connected directly or indirectly to a downhole pump having a rotor that is rotated to pump fluids to the surface of a well, the tubing string rotator comprising a housing having a first portion, a second portion and a generally hollow bore to permit the passage of a pump rod and well fluids through said housing, said second portion of said housing rotatable relative to said first portion of said housing, at least said second portion of said housing adapted to be operatively connected to the end of a length of tubing string such that rotational torque applied to the tubing string through the operation of the pump is transferred to said second portion of said housing; and, a hydraulic, mechanical or frictional braking mechanism to retard the rotational movement of said second portion of said housing such that said second portion together with the tubing string connected thereto is permitted to rotate at a controlled rate relative to said first portion of said housing when the ability of said first portion of said housing to rotate within the well is restricted and when rotational torque is supplied to the tubing string through the rotation of the rotor of the pump.

The invention also relates to a method for rotating a tubing string in a well within which there is situated a downhole pump that is connected directly or indirectly to the tubing string, the method comprising the steps of (i) providing a tubing string rotator, said rotator having a housing with a first portion and with a second portion that is rotatable relative to said first portion; (ii) operatively connecting said second portion of said housing to the end of a length of the tubing string such that rotational torque applied to the tubing string through the operation of the pump is transferred to said second portion of said housing; (iii) retarding or eliminating rotational movement of said first portion of said housing when said second portion of said housing is rotated by the tubing string; and, (iv) providing a braking means to retard rotational movement of said second portion of said housing relative to said first portion of said housing and to thereby permit the controlled rotation of said second portion of said housing and the tubing string connected thereto.

In an alternate embodiment the method of the present invention concerns a method for rotating a tubing string in a well within which there is situated a downhole pump that is connected directly or indirectly to the tubing string, the method comprising the steps of: (i) providing a tubing string rotator, said rotator having a housing with a first portion and with a second portion that is rotatable relative to said first portion; (ii) providing a hollow interior bore through said rotator housing and inserting a pump rod therethrough, said pump rod connected to the downhole pump such that rotation of said pump rod causes rotational movement of a rotor of the pump; (iii) operatively connecting said second portion of said housing to the tubing string such that rotational torque applied to the tubing string through the rotation of the rotor of the pump is transferred to said second portion of said housing; (iv) retarding or eliminating rotational movement of said first portion of said housing when rotational torque is transferred to said second portion of said housing by the pump; and, (v) providing a braking means to retard rotational movement of said second portion of said housing relative to said first portion of said housing and to thereby permit the controlled rotation of said second portion of said housing and the tubing string connected thereto, when rotational torque is transferred to said second portion of said housing by the operation of the pump.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein. For example, the drawings and the description that are set out below are directed specifically to an oil well application, however, it should be noted that the tubing string rotator of the present invention may be equally applied to a water well.

Figure 1:
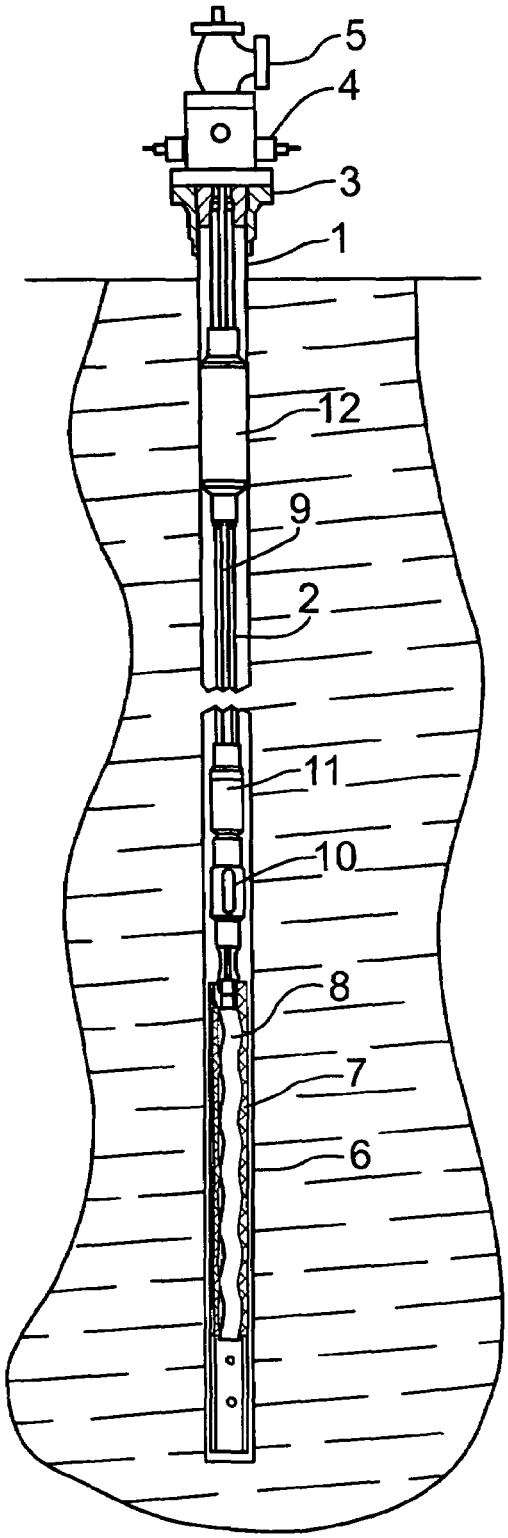
FIG. 1 is a side sectional view of a typical oil well showing the tubing string rotator of the present invention.

In FIG. 1 there is shown in cross-section a relatively generic oil well as it may be configured during the production phase. The well will typically include of a well casing 1 extending from the surface of the ground down into the oil bearing strata. The casing maintains the well in an open condition and prevents caving and sloughing of material into the well. Situated within the casing is a production tubing string 2 that is typically hung within the well by means of a tubing string hanger or dognut 3. A variety of different types of production equipment may be positioned upon the wellhead above the tubing string hanger. Such equipment, amongst other devices, could include a blowout preventer 4 and a flow tee 5. In the embodiment shown in FIG. 1, a downhole pump 6 (which may be a progressive cavity, rotary, screw or other form of pump) is connected to the lower end of production tubing string 2. Here pump 6 is comprised generally of a stator housing 7 and a rotor 8 that is turned by means of a rotating pump rod 9 extending from a surface drive system down through the production tubing string (although it will be appreciated that other forms or methods of operating the pump could also be employed while remaining within the scope of the invention). A no-turn tool 10 may be used to fix the downhole pump relative to the casing and a swivel 11 may be inserted into the string above the no-turn tool in order to permit the string to be rotated so as to evenly distribute wear about its interior surface without disengaging the no-turn tool.

In accordance with one of the embodiments of the present invention both the swivel 11 and no-turn tool 10 shown in FIG. 1 are eliminated and a tubing string rotator 12 is inserted into the string, preferably at or near the surface. Upon a complete and thorough understanding of the invention it will be appreciated that while tubing string rotator 12 may take any one of a wide variety of different forms, in each instance its overall function will be the same; namely, to provide a means to permit the controlled rotation of the tubing string within the well through harnessing the rotational torque applied to the string by the operation of pump 6. That is, as the rotor in pump 6 is turned by pump rod 9, an element of rotational torque (which can vary but may be as high as 800 foot-pounds) will be imparted to the stator, which will in turn be transmitted to the tubing string and ultimately to rotator 12. The rotator utilizes that rotational energy applied to the tubing string as a means to permit the string to rotate in a slow (for example, typically one revolution per day) and controlled manner so that erosion and wear of the string is evenly distributed about its inner surface. It will be further understood that through harnessing the rotational energy applied to the tubing string, rotator 12 has no need to rely upon external sources of mechanical, hydraulic or electromechanical power, as in the case of currently utilized tubing string rotators.

Figure 2:
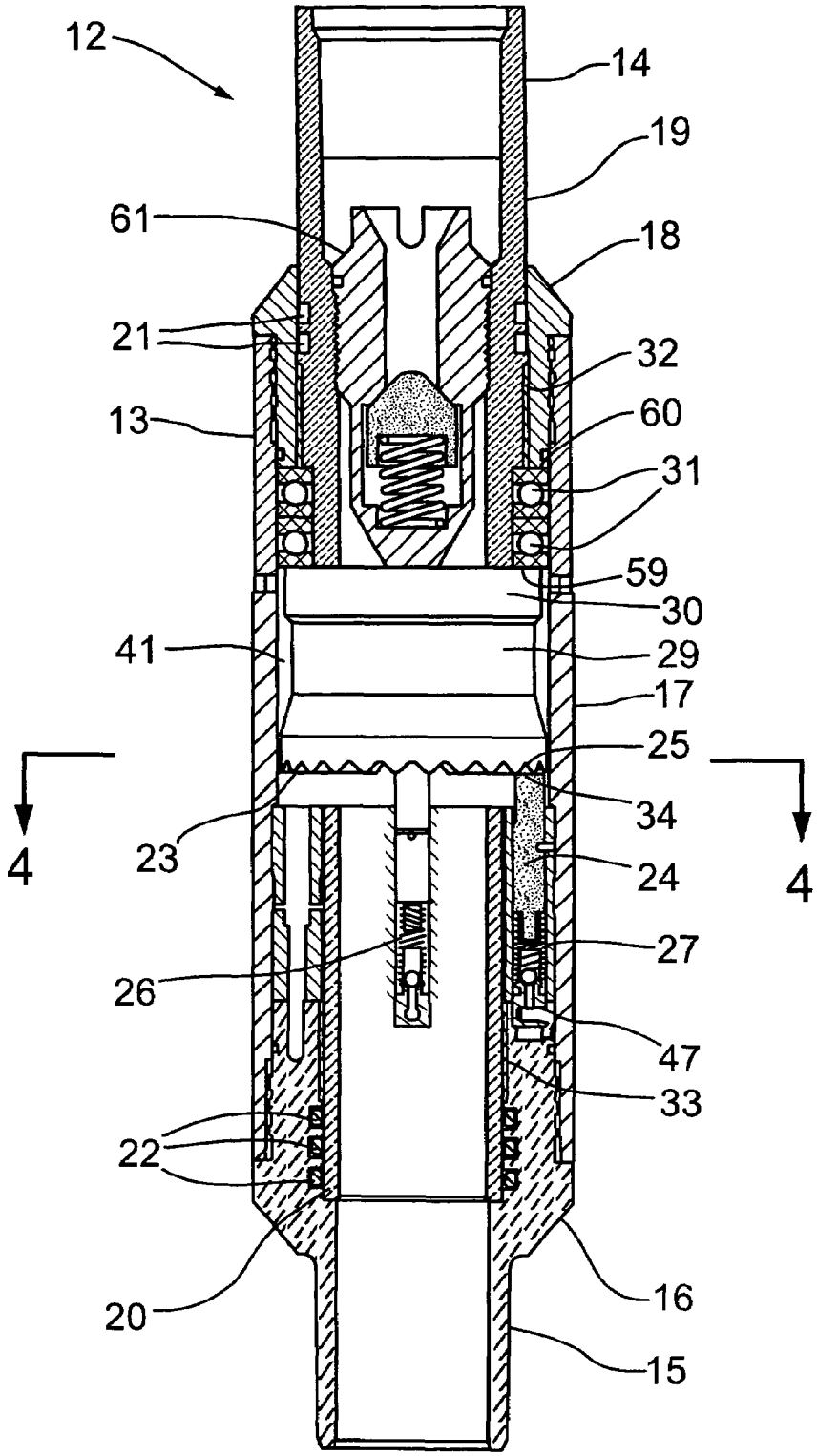
FIG. 2 is a cross-sectional view taken through the longitudinal axis of a tubing string rotator in accordance with one of the preferred embodiments of the present invention.

Referring now to FIG. 2, there is depicted one of the preferred structures for tubing string rotator 12 in accordance with the current invention. In this embodiment, rotator 12 is comprised generally of a housing 13 having a first portion 14 and a second portion 15. In the Figure, first portion 14 is the upper end of the housing while second portion 15 is the lower end of the housing. In alternate embodiments of the rotator the relative positions of the first and second portions may be reversed. Further, the first and second portions may also be concentric portions, or one portion may be otherwise received within the other. As is described in more detail below, in the embodiment shown in FIG. 2 second portion 15 is rotatable relative to first portion 14 and at least the second portion of the housing is adapted to be operatively connected to the end of a length of the tubing string such that rotational torque applied to the tubing string through operation of pump 6 is transferred to the second portion of the housing. Typically the connection between the second portion of the housing and the tubing string will be accomplished through a standard threaded connection, however, in some instances other forms of connection may be utilized. There may also be an intermediary nipple or pup joint positioned between the upper and/or lower ends of the housing and the tubing string.

Second portion 15 of housing 13 is itself formed of three general parts. The bottom most aspect of second portion 15 is comprised of a bottom sub 16 to which there is threadably secured a torque tube 17 that extends upwardly and comprises the majority of the exterior surface of the rotator. An upper top nut 18 is threadably secured to the upper end of the torque tube and serves to both facilitate the assembly of the internal components of the rotator, and to securely hold the first and second portions of the housing together. First portion 14 is generally comprised of a mandrel 19 that is rotationally received within top nut 18 and torque tube 17. The bottom end 20 of mandrel 19 may extend into a hollow bore within the interior of bottom sub 16 in order to enhance the overall rigidity of rotator 12 and its ability to endure a side load.

As is also shown in FIG. 2, both first and second portions 14 and 15 contain a generally hollow interior, such that when the respective ends are assembled together their interiors are in fluid communication with the tubing string to permit the passage of the pump rod and well fluids therethrough. A series of upper seals 21 and lower seals 22, situated between the first and second portions of the housing, help to prevent fluid passing through the tubing string from leaking into the interior of the housing and fluid exterior to the tubing string from leaking into the interior of the housing. A back pressure value 61 may also be inserted into the hollow interior of the rotator to seal the tubing if necessary.

According to the invention, rotator 12 includes means to permit the controlled rotation of second portion 15 of housing 13, together with the tubing string connected thereto, relative to first portion 14 of the housing when the ability of the first portion to rotate is retarded, restricted or eliminated. In the embodiment of the invention shown in FIG. 2, such means is a braking means or braking mechanism 23. Braking mechanism 23 may be comprised of a hydraulic, mechanical or frictional brake, or for that matter a wide variety of other structures that assist in retarding, slowing or otherwise controlling the rotational movement of the second portion of the housing. The particular braking mechanism shown in FIG. 2 is comprised generally of one or more pistons 24 that interact with one or more cammed surfaces 25. Pistons 24 may be received within second portion 15 of housing 13 with cammed surfaces 25 positioned on first portion 14 of housing 13. One or more biasing means 26 cause the pistons to engage cammed surface 25 so that the interaction of the pistons with the cammed surface permits a controlled rotational movement of the second portion of the housing when torque is applied thereto. As will be discussed in more detail below, biasing means 26 may comprise a spring 27 and/or one or more hydraulic cylinders 28. In the embodiment shown in FIGS. 1 through 8 both a spring 27 and a cylinder 28 are utilized, with the spring situated within the cylinder. The cylinders may be integral parts of the rotator housing or may be separate components received within the first and/or second portions of the housing.

Figure 3:
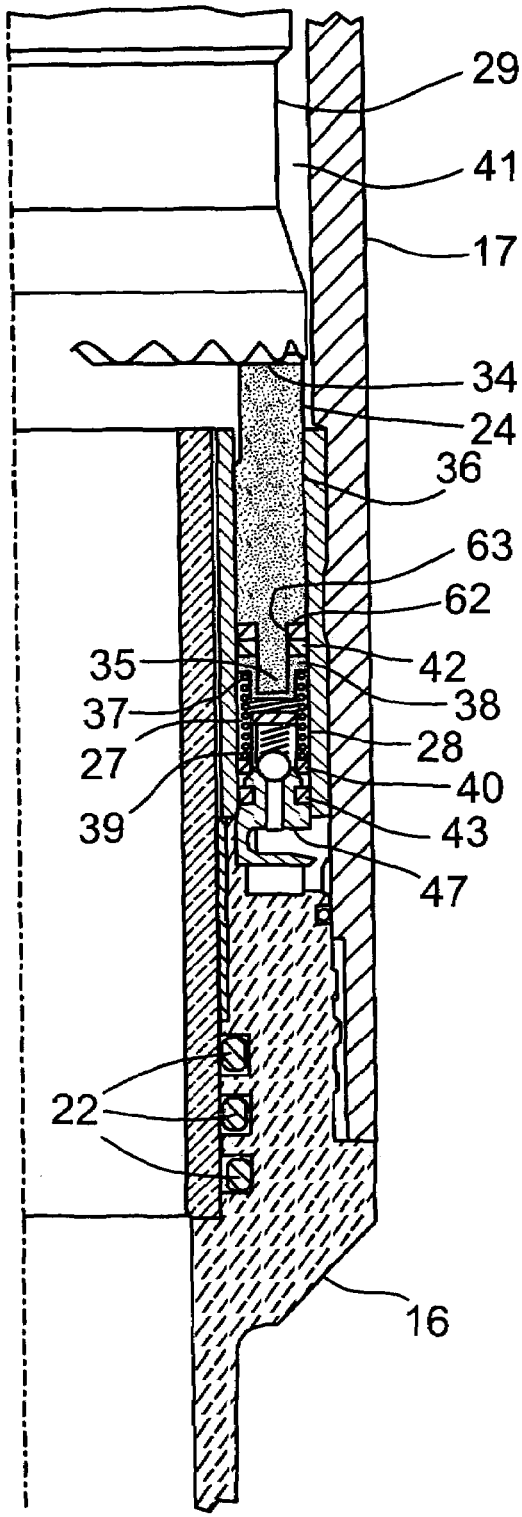
FIG. 3 is an enlarged detailed view of the lower portion of the tubing string rotator shown in FIG. 2.

Referring to FIGS. 2 and 3, mandrel 19 of first portion 14 includes a cam nut 29, the lower surface of which comprises cammed surface 25 against which pistons 24 interact. Cam nut 29 is received within torque tube 17 with sufficient clearance between the exterior of the cam nut and the interior of the torque tub to permit free rotation of the torque tube about the cam nut. The upper surface 59 of the cam nut comprises a radial flange 30 which serves as a lower shoulder upon which one or more bearings 31 may act in order to facilitate rotational movement between the first and second portions of the housing. The lower interior surface 60 of top nut 18 acts as an upper shoulder to define a containment chamber for bearings 31. Under the above described structure the weight of the tubing string that is transferred to the second portion of the housing will be borne by top nut 18 and transferred through bearings 31 to radial flange 30 upon cam nut 29. Since the cam nut is an integral part of mandrel 19, the weight of the string will thereby be transferred to the mandrel and ultimately to a tubing string hanger, dognut or other device used to suspend the string within the well. An upper bushing 32, positioned between mandrel 19 and top nut 18, together with a lower bushing 33, positioned between the bottom end 20 of mandrel 19 and bottom sub 16, help to facilitate rotary movement between the first and second portions of the housing. The bushings also help to accommodate any side loading or bending moment applied to the rotator.

In the embodiment of the invention shown in FIG. 2, one or more pistons 24 may be utilized. While the interaction of a single piston with the cammed surface of cam nut 29 will permit a controlled rotation of the second portion of the housing relative to the housing's first portion, as the end of the piston rides over the cammed surface movement of the second portion of the housing will tend to be rough or "jerky". Increasing the number of pistons and increasing the undulations in the cammed surface of cam nut 29, so that at any point in time the ends of individual pistons interact with various parts of the undulating cammed surface, will tend to smooth out the rotary movement of the second portion of the housing. In the embodiment shown (see FIG. 4) 16 pistons are utilized. It will, however, be appreciated that in alternate embodiments more or fewer than 16 pistons could equally be incorporated into the structure while having little effect upon the rotator's operation.

Figure 7:
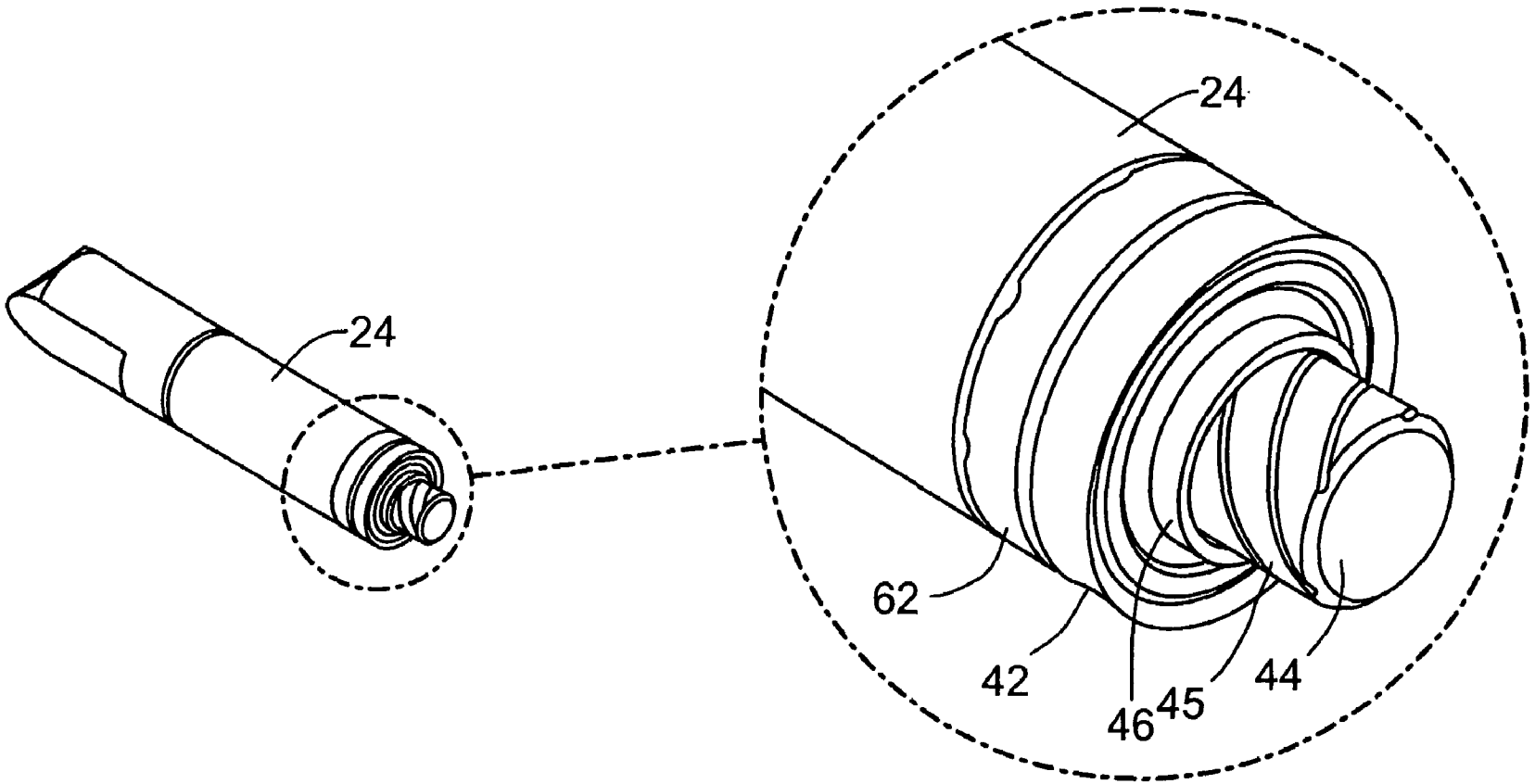
FIG. 7 is an enlarged detailed view of the lower end of one of the pistons of the tubing string rotator shown in FIG. 2.
Figure 8:
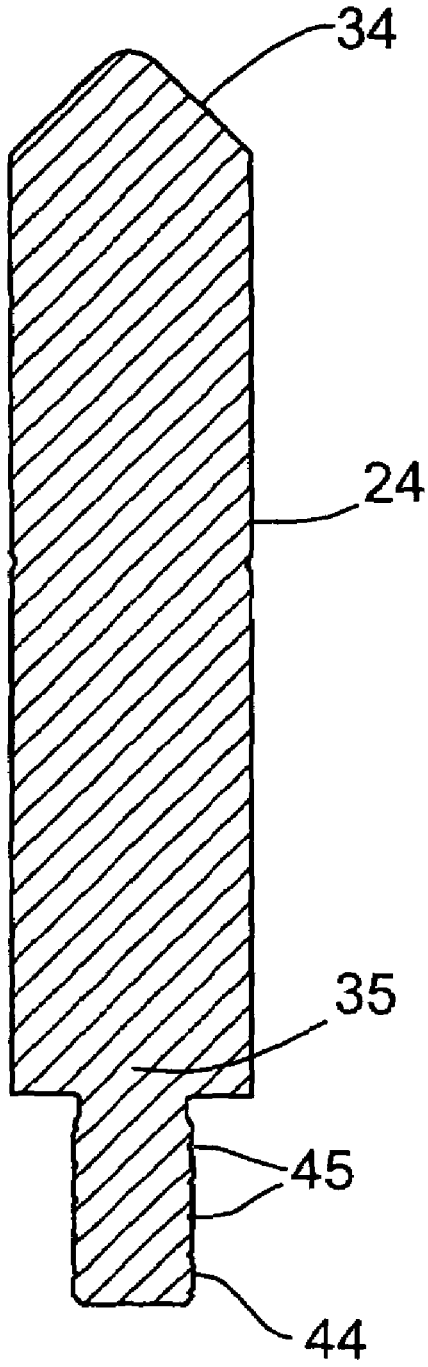
FIG. 8 is a longitudinal sectional view of one of the pistons shown in the tubing string rotator of FIG. 2.

With reference to FIGS. 3, 7 and 8, the structure of the pistons used in one of the preferred embodiments of the invention that is illustrated will now be described in further detail. Generally, pistons 24 are comprised of elongate cylinders having an upper or leading end 34 that interacts with cammed surfaces 25, and a lower or trailing end 35 that, in the case of the embodiment shown in the attached drawings, is received within a piston cylinder 36 situated within second portion 15 of housing 13. As will become apparent from an examination of the enclosed drawings, lower end 35 of piston 24 is also operatively connected, or otherwise in communication, with one of the hydraulic cylinders 28. Situated within hydraulic cylinder 28 may be a spring 27 having an upper end 37 received against a spring cap 38, that is in turn received about lower end 35 of piston 24. Spring 27 further includes a lower end 39 that abuts a spring stop 40. The combined function of spring 27, spring cap 38, and spring stop 40 is to create a biasing force that is applied to lower end 35 of piston 24 tending to drive the piston in an upward direction, and to maintain contact between the piston's upper end and cammed surface 25.

Preferably a hydraulic flow path places hydraulic cylinders 28 in fluid communication with a fluid reservoir 41 such that when the cylinders are filled with pressurized fluid the fluid will migrate from the cylinders to the reservoir. To accomplish this, within the hydraulic flow path connecting the reservoir and each cylinder 28 there is positioned one or more orifices 63 that control and retard the flow of fluid from the cylinders to the reservoir. Fluid is prevented from escaping through the upper end of hydraulic cylinder 28 through the use of a seal 42. Similarly, a seal 43 prevents the escape of fluid through the bottom of the cylinder. Through the operation of seals 42 and 43 the only manner of movement of fluid out of hydraulic cylinder 28 is by way of the one or more orifices mentioned above. The reservoir may also include a magnet to trap and collect metal particles that may be present in the fluid, particularly following break-in of the tool.

The orifice or orifices that connect fluid reservoir 41 to hydraulic cylinders 28 may have various different physical structures. In the embodiment shown in FIGS. 2 through 8 lower end 35 of piston 24 has a reduced diameter portion 44 about the circumference of which is positioned a helical channel 45. Encompassing reduced diameter portion 44 is a flow ring 46 that is press fit over the reduced diameter portion. Press fitting flow ring 46 over reduced diameter portion 44 has the effect of forming a helical flow passageway or orifice that presents a means for fluid to pass out of hydraulic cylinder 28. In one version of the invention, the operation of check valves (described in more detail below) results in the helical flow passageway formed between reduced diameter portion 44 and flow ring 46 being the only manner for fluid to flow out of cylinders 28.

As shown in FIGS. 3 and 7, once fluid from hydraulic cylinder 28 flows through the helical orifice and passes seal 42, it is allowed to escape into that portion of piston cylinder 36 that surrounds the outside diameter of piston 24 by flowing through openings in the top 62 of flow ring 46. From that point the fluid is free to flow into fluid reservoir 41. It should also be noted that in an alternate embodiment of the invention the reduced diameter portion of the pistons, the flow ring and the seal may be incorporated into a single structure having one or more orifices therethrough that permits the controlled flow of pressurized fluid out of cylinders 28.

Figure 3A:
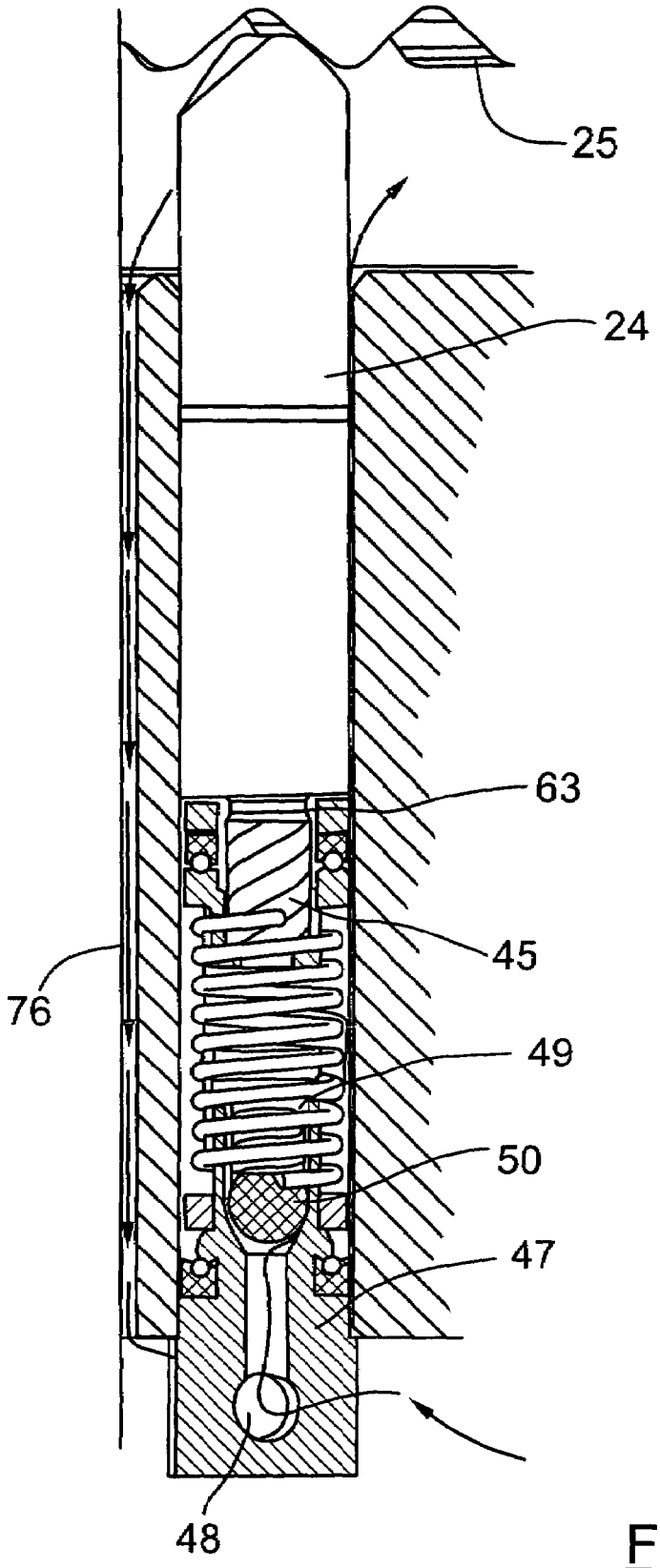
FIG. 3A is an enlarged detailed view of one of the cylinders and pistons shown in FIG. 3 having the fluid flow path of one of the preferred embodiments of the invention shown thereon.
Figure 4:
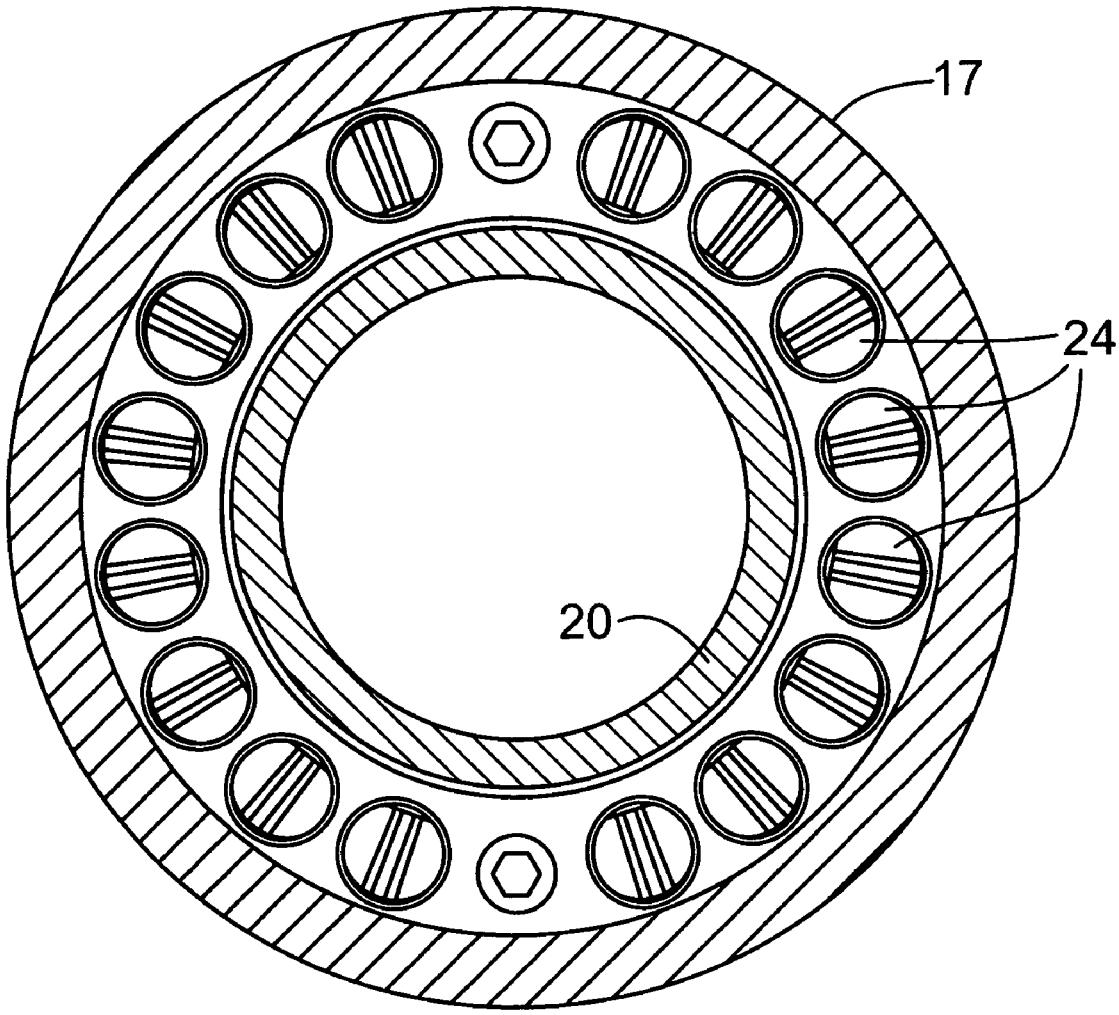
FIG. 4 is a sectional view taken along the line 4-4 of FIG. 2.
Figure 6:
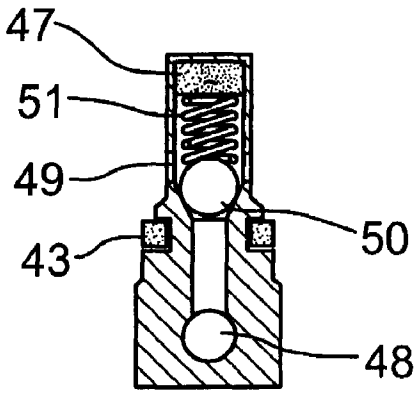
FIG. 6 is an enlarged detailed view of the check valve assembly shown in FIG. 2.

FIG. 6 depicts a check valve 47 which effectively forms the bottom of hydraulic cylinder 28. Check valve 47 is dimensioned so as to be received within cylinder 28 and presents a mechanism upon which seal 43 may be carried. The check valve includes a fluid intake 48, a vent hole 49, a ball 50, and a spring 51. The purpose of the check valve is to enable fluid to be pumped or otherwise delivered into hydraulic cylinder 28, and to thereafter prevent or limit the escape of fluid through the bottom portion of the cylinder when it is pressurized. When the cylinders are in a vacuum state or are being filled with fluid (which it is expected in most instances will be hydraulic oil) fluid is drawn from reservoir 41, through a connecting passageway 76, through fluid intake 48, and out vent hole 49 into cylinder 28 (see FIG. 3A). When no longer under a state of vacuum, spring 51 forces ball 50 to seat against the fluid intake passageway forming a seal therebetween to prevent leakage of fluid out of the bottom of the hydraulic cylinder. In an alternate embodiment to that shown in the attached drawings, orifices 63 may be contained within the check valves rather than being incorporated within the lower end of the pistons, such that fluid flowing out of the cylinders must pass through the orifices within the check valves prior to entering reservoir 41.

Figure 5:
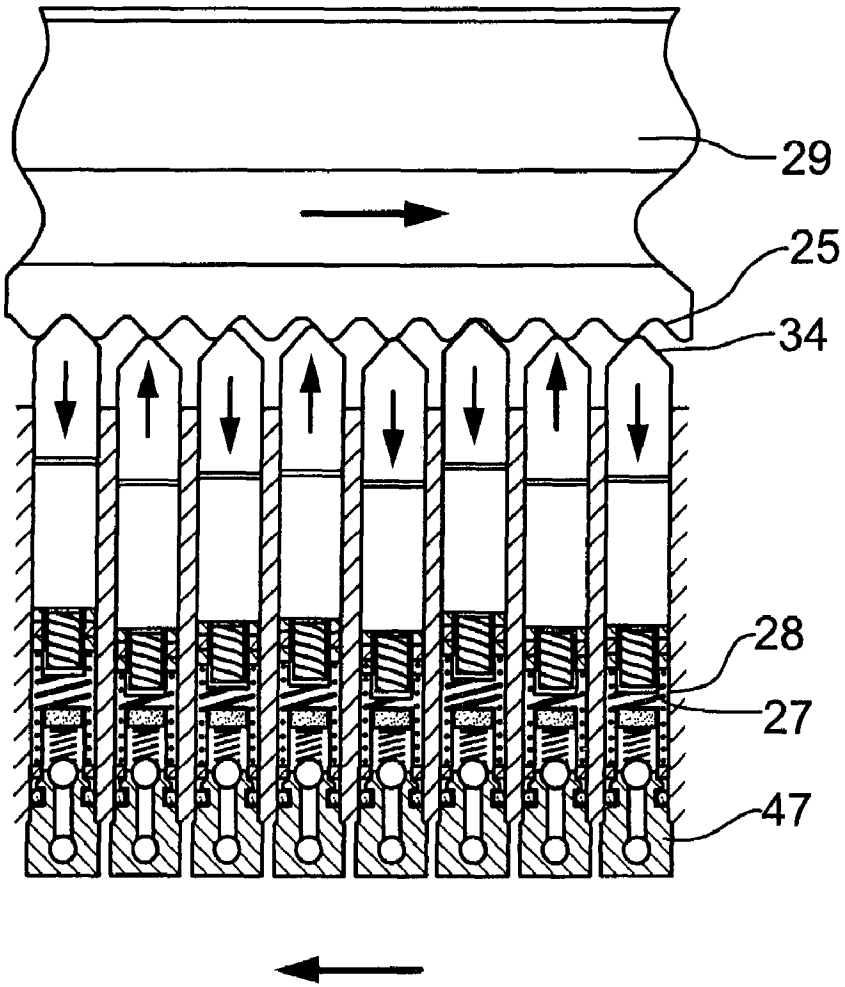
FIG. 5 is a schematic view showing the operation of a plurality of pistons within a tubing string rotator constructed in accordance with one of the preferred embodiments of the present invention.

The operation of pistons 24 and their interaction with cammed surface 25 will now be described in further detail with specific reference to FIG. 5. As mentioned, preferably a plurality of pistons are situated within second portion 15 of housing 13 such that the upper ends of the pistons contact the cammed surface on first portion 14 of the housing at various points along the cam profile. In FIG. 5, if a torque is applied to the second portion of the housing in a direction toward the left, the upper ends 34 of pistons 24 will tend to engage cammed surface 25 of cam nut 29 causing the pistons to move in a upward and downward direction as they ride over the cam's profile. When being pushed downwardly along the sloping surface of the cam nut a piston will tend to compress the fluid within its associated hydraulic cylinder, forcing fluid to flow through orifice 63 and into fluid reservoir 41. Pushing the fluid through the orifice into the reservoir has a retarding effect on its flow, which in turn results in a slow and controlled movement of the piston in a downward direction.

Once enough fluid has been forced from cylinder 28 to allow the tip of the piston to clear the lower most portion of the cammed surface, further rotation of the second portion of the housing will allow the piston come into contact with the upward sloping portion of the cam profile. At that point the pressure forcing fluid from cylinder 28 will be relieved and spring 27 will tend to drive the piston upwardly, which will in turn have the effect of drawing fluid back through the check valve and into the cylinder. Once rotation of the second portion of the housing has advanced far enough to allow the piston to move upwardly to the point where its tip contacts the trough of the cammed surface, the piston will be restricted from further upward movement. Continued rotation of the second portion of the housing will at that point cause the process to repeat itself with the piston once again being driven in a downward direction, with fluid slowly forced from cylinder 28 through the orifice into reservoir 41, as the upper end of the piston rides along the downwardly sloping cam surface.

By way of the above piston movement, and through the use of a plurality of pistons contacting various portions of the cam profile, a smooth, slow and controlled rotational movement of the second portion of the rotator housing relative to the rotator's first portion is achievable. The structure also helps to balance the hydraulic flow within the rotator since some of the pistons will be moving downward and forcing fluid from the hydraulic cylinders while others will be moving upward and drawing fluid into the hydraulic cylinders. It will also be appreciated that through a modification of the cam profile, by altering the size of the orifice between hydraulic cylinders 28 and fluid reservoir 41, and/or through the utilization of fluids having different viscosities, the retarding effect that the braking mechanism has upon the rotation of the second portion of the housing will be altered. In this manner the rotator's components can be constructed to permit a controlled rotation of the second portion of the housing at a pre-determined rate.

In the embodiment of the invention shown in FIG. 2 the first portion of the rotator housing is preferably held or otherwise secured within the well in order to retard (or preferably eliminate) rotational movement of the first portion when the second portion is subjected to rotational torque by the tubing string. The second portion of the rotator and the string are allowed to rotate relative to, and independently from, the first portion of the rotator housing. To hold or secure the first portion 14 of the housing within the well the first portion may be operatively connected to the well casing through bolting it directly to the wellhead. Alternately, a splined or similar mechanical connection may be utilized that provides for easier extraction of the rotator from the well should it become necessary. As mentioned previously, in a further embodiment the first portion of the rotator may be held and secured within the well through the use of a tubing string hanger that suspends both the housing and the tubing string. Where a tubing string hanger is utilized, it may take the form of an integral part of rotator 12 that is connected to mandrel 19. Alternately, a dedicated tubing string hanger could be utilized to which mandrel 19 may be secured directly, by means of an intermediary length of tubing, or through a short pup joint. While it is only necessary to retard or restrict the rotational movement of first portion 14 to an extent that enables braking mechanism 13 to operate and to permit a controlled rotation of second portion 15 relative to first portion 14, in most instances it is anticipated that first portion 14 of housing 13 will be held securely in position so that it does not rotate, One of reasonable skill in the art will understand that a variety of different braking mechanisms could be used in rotator 12 while remaining within the broad scope of the invention. For example, in an alternate embodiment to that as shown in FIGS. 2 through 8, the cammed surfaces may be positioned upon the outside diameter of the cam nut with the pistons situated and operating in a generally horizontal plane. The relative location of the cammed surface and the pistons could also be reversed, with the pistons received within first portion 14 of housing 13 and the cammed surface forming part of second portion 15.

Figure 9:
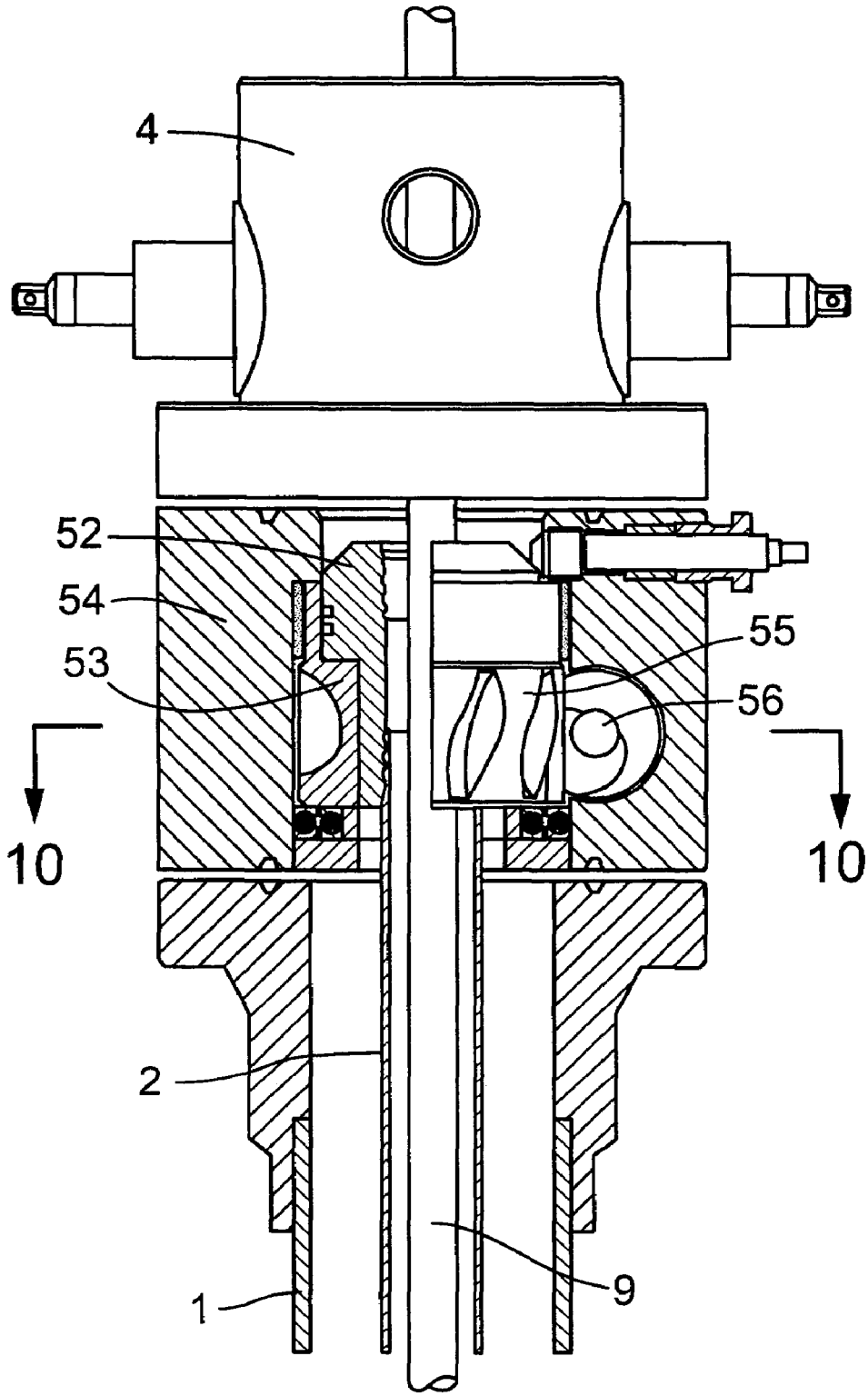
FIG. 9 is a side sectional view of an alternate embodiment of the rotator shown in FIG. 2.
Figure 10:
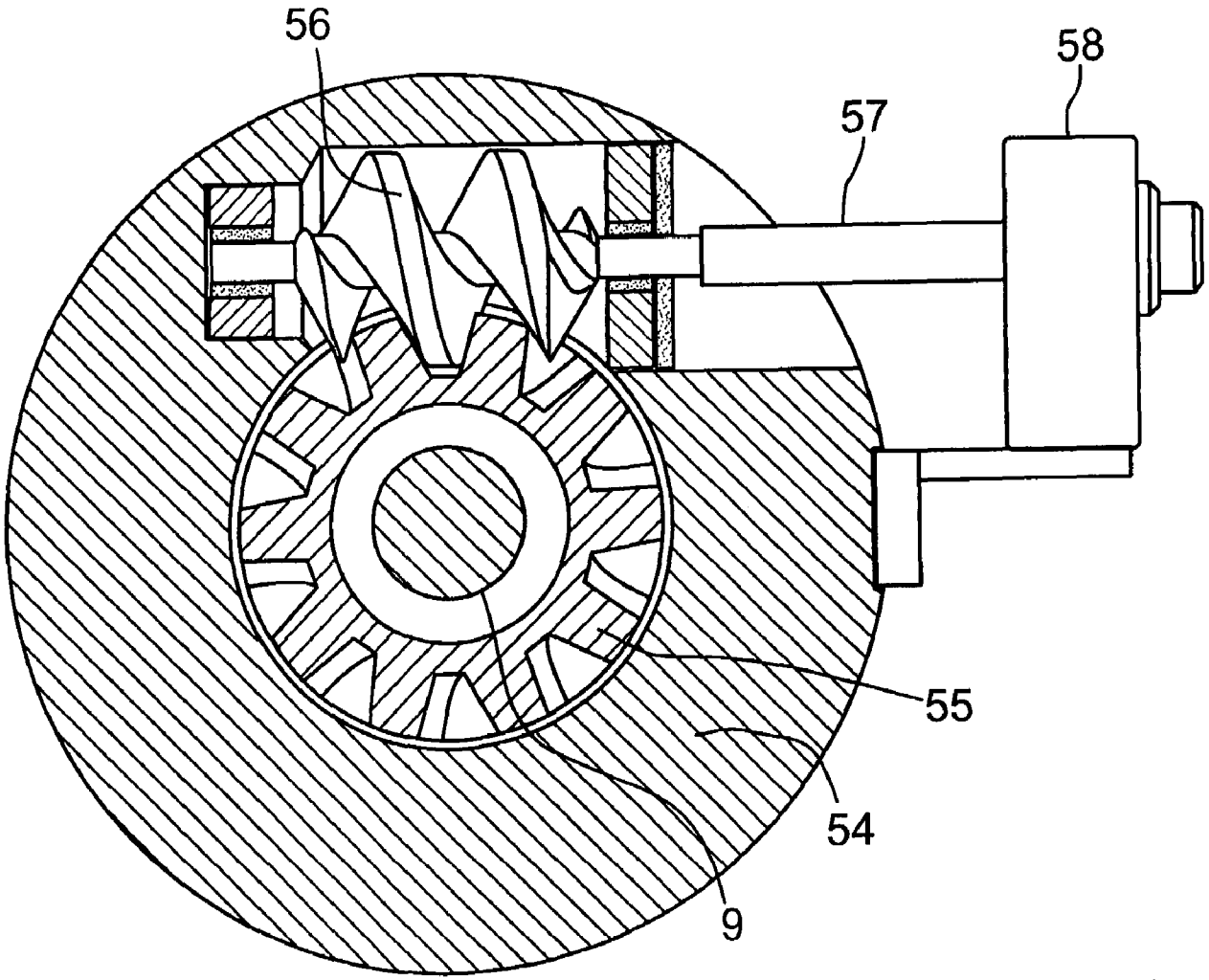
FIG. 10 is a sectional view taken along the line 10-10 of FIG. 9.

In a further embodiment of the invention, rotator 12 may be of a more traditional configuration that includes a bull gear drive (see FIGS. 9 and 10). In this embodiment the tubing string is operatively connected to a mandrel or dognut 52 suspended within a gear housing 53 that is in turn rotatably positioned with a rotator shell 54. In a slightly varied structure the mandrel many be rotatably suspended directly within the rotator shell without the use of the gear housing. Where is gear housing is utilized, the mandrel is preferably secured to the gear housing through a splined, friction or similar connection that allows for rotation of the gear housing upon rotation of the mandrel. The splined or similar connection between the mandrel and the gear housing also permits the mandrel and the tubing string to be readily pulled from the well if necessary. It will be appreciated that the mandrel and the gear housing together (or the mandrel independently where no gear housing is utilized) effectively function as second portion 15 of the rotator housing while the rotator shell functions as the rotator's first portion 14.

In the embodiment shown in FIG. 9, a bull gear 55 is positioned on the exterior surface of gear housing 53 and engages a corresponding and mating gear 56 (which may be a worm gear or other form of gear) such that rotation of mandrel 52 and gear housing 53 causes rotation of gear 56. Of course where no gear housing is used, bull gear 55 is preferably positioned on the exterior of mandrel 52. A shaft 57 may extend from gear 56 to a torque limiter 58. Where utilized, torque limiter 58 provides a braking or retarding effect upon both shaft 57 and gear 56, which in turn permits a slow and controlled rotation of mandrel 52 and the tubing string attached thereto. Torque limiter 58 can take any one of a wide variety of different structures from purely frictional devices that dissipate torque generated by the pump rotor to mechanical devices that may direct the excess energy for use in other applications. In a further alternate embodiment one or more gears may be driven by the rotating mandrel without the use of a torque limiter. In such an instance the configuration of the one or more gears will be relied upon to retard or control rotation of the mandrel and hence the tubing string.

Figure 11:
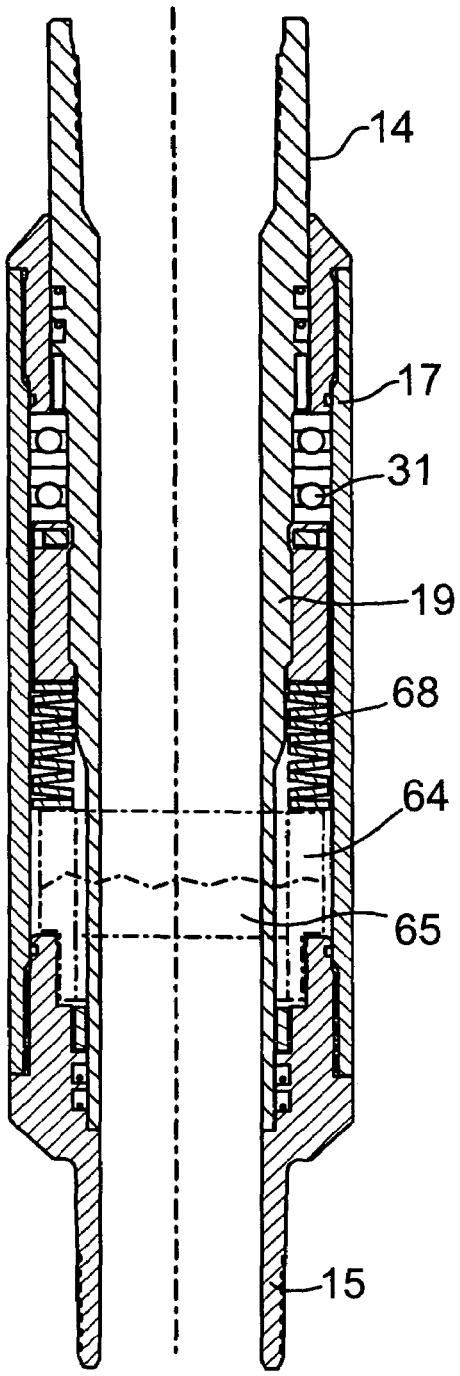
FIG. 11 is a longitudinal sectional view of an alternate embodiment of the rotator shown in FIG. 2.
Figure 12:
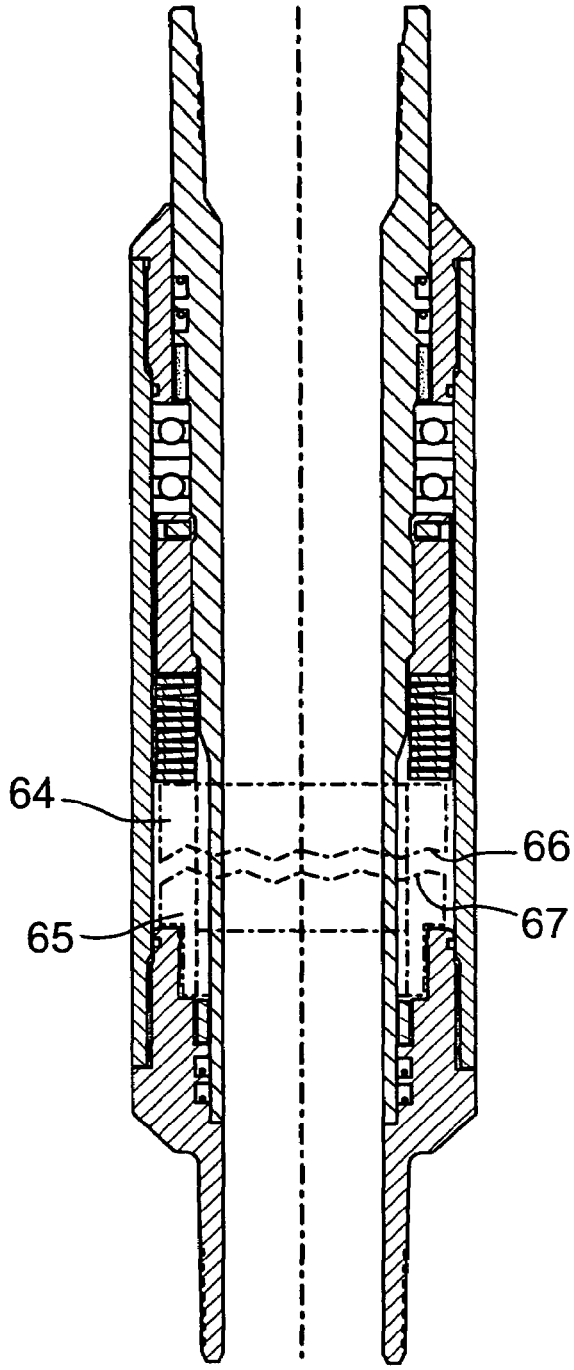
FIG. 12 is a longitudinal sectional view of the rotator of FIG. 11 showing its cammed surfaces riding over one another.

FIGS. 11 through 17 show yet further embodiments of the invention that employ alternate braking mechanisms to those shown in FIGS. 1 through 10. In FIGS. 11 and 12 there is depicted a tubing string rotator 12 having a braking mechanism 23 that includes an upper cam nut 64 and a lower cam nut 65. Cam nuts 64 and 65 have corresponding cammed surfaces 66 and 67, respectively. In this particular embodiment of the invention lower cam nut 65 is secured to the lower end 15 of housing 13 through threading the cam nut to the housing or otherwise securing the two parts together. Upper cam nut 64 is slidably received over mandrel 19 and biased towards lower cam nut 65 through the operation of a plurality of belleville washers 68. It should, however, be noted that a variety of other mechanisms may be utilized to bias the two cam nuts together (including traditional coil springs, leaf springs, hydraulic or pneumatic pistons, etc) and that the relative positions of the cam nuts may be reversed within housing 13.

Biasing the cammed surfaces of upper and lower cam nuts 64 and 65 toward one another will effectively prevent rotational movement between the upper and lower ends of the housing until such time as the torque applied to the housing by the action of pump 6 is sufficient to overcome the biasing force applied by the belleville washers (or such other means as are employed). When sufficient torque is applied the cammed surfaces of the cam nuts will "ride" over one another and permit a stepped rotational movement between the upper and the lower ends of the rotator housing. The described structure will therefore provide for a controlled and stepped rotational movement of the lower end of the housing through the utilization of the torque applied to the rotator by the operation of pump 6.

Figure 15:
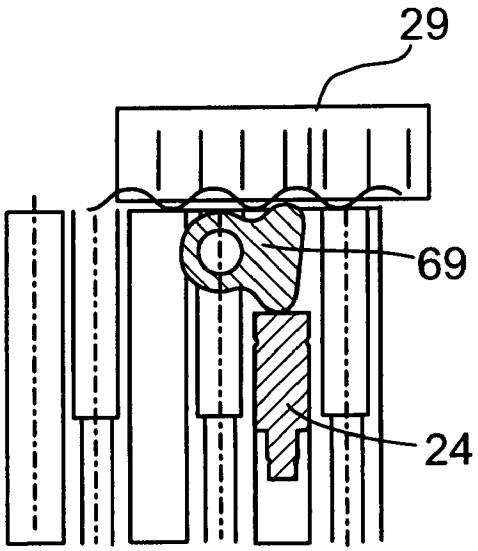
FIG. 15 is a detail view similar to FIG. 14 wherein the upper and lower portions of the rotator housing have been rotated relative to one another.
Figure 14:
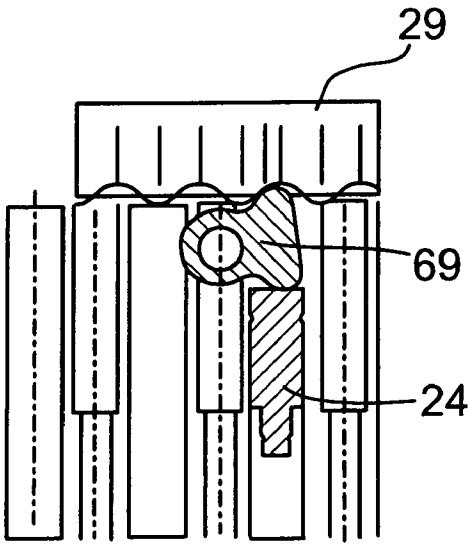
FIG. 14 is a detail view similar to FIG. 13 wherein the upper and lower portions of the rotator housing have been rotated relative to one another.
Figure 13:
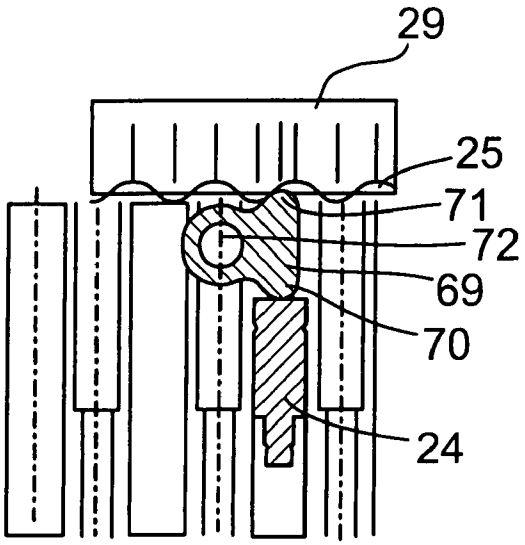
FIG. 13 is a detail view of an alternate embodiment of the braking mechanism of the rotator shown in FIG. 2.

FIGS. 13 through 15 illustrate a variation to the embodiment of the invention shown in FIGS. 2 through 8. Here the operation of piston 24 is essentially the same as described above with respect to the embodiment shown in FIGS. 2 through 8, with the exception that the upper or leading ends 34 of pistons 24 do not contact cammed surface 25 directly. Instead, positioned above each piston 24 within the lower end 15 (or the upper end as the case may be) of the rotator housing is a lifter 69. Lifter 69 has a lower end 70, that engages the upper end 34 of piston 24, and an upper end 71, that engages cammed surface 25 of cam nut 29. As shown, lifter 69 is rotatable about an axis 72 that is generally perpendicular to piston 24 in such a manner that longitudinal movement of the piston causes the upper end 71 of the lifter to either engage or to be withdrawn from cammed surface 25. FIGS. 13, 14 and 15 show lifter 69 in three positions. In FIG. 13 piston 24 is being moved toward the cam nut and effectively driving the upper end of the lifter into the surface of the cam nut. In FIG. 14 the piston has reached its upper-most position with upper end 71 of lifter 69 positioned within a valley of cammed surface 25. Finally, in FIG. 15 the piston has been retracted permitting the lifter to be rotated away from the cammed surface and allowing the upper end 71 of the lifter to ride over the peak surface of the cam. When piston 24 is retracted, the lifters are rotated away from cammed surface 25 through the operation of gravity or through the use of a spring (not shown). It will therefore be appreciated that the engagement of lifters 69 with cammed surface 25 permits a controlled rotational movement of the lower end of the rotator housing relative to its upper end through harnessing and controlling torque applied to the rotator by the operation of pump 6.

Figure 16:
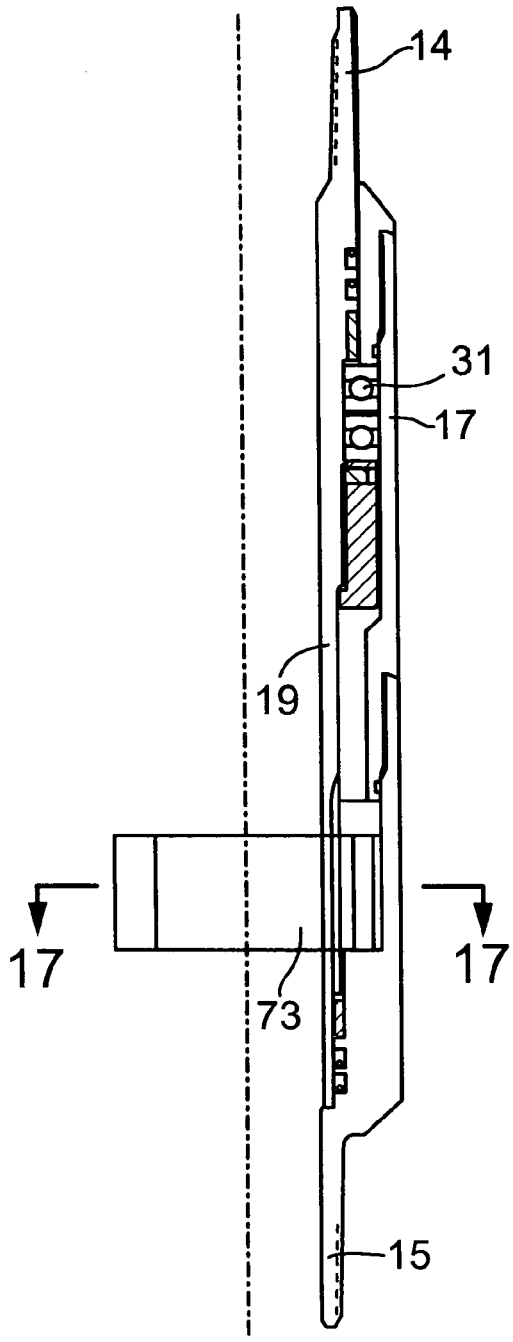
FIG. 16 is a partial longitudinal sectional view of a further alternate embodiment of the rotator shown in FIG. 2; and, FIG. 17 is a sectional view taken along the line 17-17 of FIG. 16.
Figure 17:
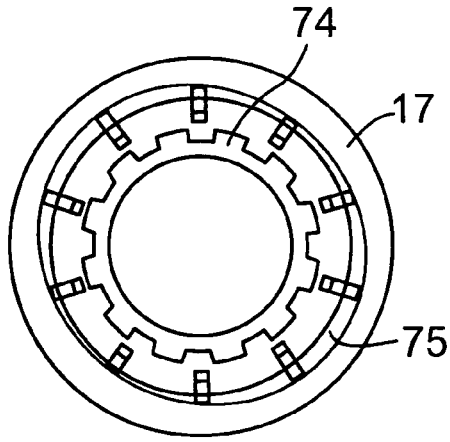

Yet a further form of a braking mechanism that may be employed in the present invention is shown in FIGS. 16 and 17. Here, braking mechanism 23 is comprised generally of a hydraulic vane pump or motor 73 having a vane pump rotor 74 and a vane pump stator 75. In the embodiment shown in FIG. 16, vane pump rotor 74 forms part of upper end 14 of housing 13 whereas stator 75 forms part of the housing's lower end 15. It should be appreciated that the relative positions of the vane pump rotor and stator could be reversed while not detracting from their function. Through the placement of a fluid having a relatively low viscosity within the vane pump housing surrounding its rotor and stator, a retarding or braking affect will be applied between the upper and loser ends of housing 13 when torque is applied to the rotator through the operation of rotary pump 6. It will thus be appreciated that through adjustment of the tolerances between the vane pump rotor and stator, and by utilizing fluids of different viscosity, the amount or degree of the braking or retarding affect that may be applied can be altered. The embodiment of the invention shown in FIG. 16 may be particularly adaptable to shallow wells, when pumping light crude oil, or in situations where lower levels of torque are applied to the rotator through the operation of the rotary pump.

It will thus be appreciated from a complete understanding of the invention that there is provided a tubing string rotator capable of harnessing the torque that is applied to the tubing string through rotation of the rotor in a progressive cavity pump as a source of mechanical energy to impart a slow and controlled rotational movement to the string. Through the incorporation of a braking mechanism operatively connected to the tubing string there is provided a means to slow and control the rotation of the string without the need to utilize external power sources, including hydraulic, pneumatic, electrical and other drive mechanisms. The braking mechanism may comprise one or more hydraulically actuated pistons, a mechanical gear system, or any one of a wide variety of braking or friction inducing structures. Depending upon the nature of the braking mechanism, the rotator may take the form of an in-line rotator (such as that shown in FIG. 2) or may be of a structure more similar to existing tubing string rotators (see FIG. 9). In either case, a controlled rotation of the tubing string is achieved without recourse to external sources of power, thereby reducing operating costs for the well. The invention also removes the necessity for the use of a no-turn tool and swivel as is required when using traditional tubing string rotators.

It is to be understood that what has been described are the preferred embodiments of the invention and that it may be possible to make variations to these embodiments while staying within the broad scope of the invention. Some of these variations have been discussed while others will be readily apparent to those skilled in the art. For example, in one embodiment of the invention one or more pistons engage a cam nut having a cam surface or profile on one side. In an alternate embodiment the cam nut may have a cam profile on two sides which may be engaged by one or more pistons. In addition, multiple cam nuts or cam nuts having multiple cam surfaces on one or more sides could be utilized.

The embodiments of the invention in which an exclusive property or privilege is claimed are defined as follows:

1. A tubing string rotator for controlling rotation of a tubing string, in a well, connected to a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) means to permit the controlled rotation of said second portion of said housing, together with the tubing string connected thereto, relative to said first portion of said housing when rotational torque is supplied to the tubing string through the operation of the pump.

2. The device as claimed in claim 1 wherein said first portion of said housing is operatively connected to the well to prevent rotational movement therebetween.

3. The device as claimed in claim 1 wherein said first portion of said housing includes a tubing string hanger to suspend said housing and the tubing string attached to said housing within the well.

4. The device as claimed in claim 1 including bearing means situated between said first and said second portions of said housing, said bearing means accommodating rotational and longitudinal loading of said first and said second portions of said housing.

5. The device as claimed in claim 1 wherein said rotator has a generally hollow interior in fluid communication with the tubing string and permitting the passage of a pump rod therethrough.

6. The device as claimed in claim 1 wherein said second portion of said housing includes a rotary mandrel and said first portion of said housing is a tubing string hanger.

7. The device as claimed in claim 1 wherein said means to permit the controlled rotation of said second portion of said housing relative to said first portion of said housing comprises a braking means.

8. A tubing string rotator for rotating a tubing string in a well having a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) a hydraulic, mechanical or frictional brake to permit the controlled rotation of said second portion of said housing, together with the tubing string connected thereto, relative to said first portion of said housing when the ability of said first portion to rotate is retarded or eliminated, and when rotational torque is supplied to the tubing string through the operation of the pump.

9. A tubing string rotator for rotating a tubing string in a well having a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) braking means to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, said braking means including one or more pistons and one or more biasing means, said pistons received within one of said first and said second portions of said housing and said biasing means causing said pistons to engage one or more cammed surfaces on the other of said first and said second portions of said housing such that the interaction of said one or more pistons with said one or more cammed surfaces permits a controlled rotational movement of said second portion of said housing relative to said first portion of said housing.

10. The device as claimed in claim 9 wherein said biasing means comprises a spring.

11. The device as claimed in claim 9 wherein said biasing means comprises one or more hydraulic cylinders.

12. A tubing string rotator for rotating a tubing string in a well having a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) braking means to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, said braking means including one or more pistons and one or more hydraulic cylinders received within at least one of said first and second portions of said housing, said pistons received within said hydraulic cylinders and engaging one or more cammed surfaces on one of said first and said second portions of said housing such that the interaction of said one or more pistons with said one or more cammed surfaces permits a controlled rotational movement of said second portion of said housing relative to said first portion of said housing upon operation of the progressive cavity pump, said one or more hydraulic cylinders comprising one or more fluid filled cylinders connected to a fluid reservoir by way of one or more orifices, said one or more orifices permitting the controlled and retarded flow of fluid between said reservoir and said one or more cylinders to permit movement of said one or more pistons relative to said one or more cammed surfaces in a controlled manner.

13. A tubing string rotator for rotating a tubing string in a well having a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) braking means to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, said braking means including a bull gear operatively connected to said second portion of said housing and a torque limiter operatively connected to said bull gear, said torque limiter controlling the rotational movement of said bull gear and thereby controlling the rate of rotation of said tubing string.

14. A tubing string rotator for rotating a tubing string in a well having a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) one or more gears operatively connected to said second portion of said housing to permit the controlled rotation of said second portion of said housing, together with the tubing string connected thereto, relative to said first portion of said housing when the ability of said first portion to rotate is retarded or eliminated and when rotational torque is supplied to the tubing string through the operation of the pump, the rate of rotation of said second portion of said housing controlled through the operation of said one or more gears.

15. A tubing string rotator for permitting the rotation of a tubing string connected directly or indirectly to a downhole pump having a rotor that is rotated to pump fluids to the surface of a well, the tubing string rotator comprising:

(i) a housing having a first portion, a second portion and a generally hollow bore to permit the passage of a pump rod and well fluids through said housing, said second portion of said housing rotatable relative to said first portion of said housing, at least said second portion of said housing adapted to be operatively connected to the end of a length of tubing string such that rotational torque applied to the tubing string through the operation of the pump is transferred to said second portion of said housing; and, (ii) a hydraulic, mechanical or frictional braking mechanism to retard the rotational movement of said second portion of said housing such that said second portion together with the tubing string connected thereto is permitted to rotate at a controlled rate relative to said first portion of said housing when the ability of said first portion of said housing to rotate within the well is restricted and when rotational torque is supplied to the tubing string through the rotation of the rotor of the pump.

16. The device as claimed in claim 15 wherein said braking mechanism includes one or more pistons, said pistons received within one of said first and said second portions of said housing and actuatable to engage one or more cammed surfaces on the other of said first and said second portions of said housing such that the interaction of said one or more pistons with said one or more cammed surfaces retards the rotational movement of said second portion of said housing while permitting a controlled rotational movement of said second portion of said housing relative to said first portion of said housing.

17. The device as claimed in claim 16 wherein said pistons are hydraulically actuated pistons.

18. The device as claimed in claim 17 including one or more fluid filled cylinders connected to a fluid reservoir by way of one or more orifices, said one or more orifices permitting the controlled flow of fluid between said reservoir and said one or more cylinders to permit the controlled movement of said one or more pistons relative to said one or more cammed surfaces, and to thereby control the rotational movement of said second portion of said housing relative to said first portion of said housing.

19. The device as claimed in claim 18 wherein each of said one or more pistons are received within piston cylinders situated within one of said first and said second portions of said housing, each of said pistons having a leading end that contacts and interacts with said one or more cammed surfaces, each of said pistons further having a trailing end in communication with one of said fluid filled cylinders such that the flow of fluid between said fluid filled cylinders and said fluid reservoir through said one or more orifices permits longitudinal movement of said one or more pistons, relative to said piston cylinders, and the interaction of said leading ends of said one or more pistons with said one or more cammed surfaces.

20. The device as claimed in claim 19 wherein said one or more fluid filled cylinders further includes a spring, said springs biasing said pistons to force said leading ends of said pistons into contact with said one or more cammed surfaces.

21. The device as claimed in claim 16 wherein said pistons are spring actuated.

22. The device as claimed in claim 15 wherein said first portion of said housing includes a tubing string hanger to suspend the tubing string and said housing within the well.

23. The device as claimed in claim 15 wherein said housing includes one or more bearings, said bearings accommodating rotational and longitudinal loading of said first and said second portions of said housing.

24. A method for rotating a tubing string in a well within which there is situated a downhole pump, the method comprising the steps of:

(i) providing a tubing string rotator, said rotator having a housing with a first portion and with a second portion that is rotatable relative to said first portion;

(ii) operatively connecting said second portion of said housing to the end of a length of the tubing string such that rotational torque applied to the tubing string through the operation of the pump is transferred to said second portion of said housing;

(iii) retarding or eliminating rotational movement of said first portion of said housing when said second portion of said housing is rotated by the tubing string; and, (iv) providing a braking means to retard rotational movement of said second portion of said housing relative to said first portion of said housing and to thereby permit the controlled rotation of said second portion of said housing and the tubing string connected thereto.

25. The method as claimed in claim 24 including the step of incorporating a tubing string hanger into the first portion of said housing and suspending said housing and the tubing string attached thereto within the well through the use of said tubing string hanger.

26. A method for rotating a tubing string in a well within which there is situated a downhole cavity pump that is connected directly or indirectly to the tubing string, the method comprising the steps of:

(i) providing a tubing string rotator, said rotator having a housing with a first portion and with a second portion that is rotatable relative to said first portion;

(ii) providing a hollow interior bore through said rotator housing and inserting a pump rod therethrough, said pump rod connected to the downhole pump such that rotation of said pump rod causes rotational movement of a rotor of the pump;

(iii) operatively connecting said second portion of said housing to the tubing string such that rotational torque applied to the tubing string through the rotation of the rotor of the pump is transferred to said second portion of said housing;

(iv) retarding or eliminating rotational movement of said first portion of said housing when rotational torque is transferred to said second portion of said housing by the pump; and, (v) providing a braking means to retard rotational movement of said second portion of said housing relative to said first portion of said housing and to thereby permit the controlled rotation of said second portion of said housing and the tubing string connected thereto, when rotational torque is transferred to said second portion of said housing by the operation of the pump.

27. A method of rotating a tubing string in a well having a downhole pump using the rotational torque supplied through operation of the pump, said method comprising the steps of:

(i) providing a housing having a first portion and a second portion, the second portion rotatable relative to the first portion, at least the second portion of the housing adapted to be operatively connected to the end of a length of the tubing string such that rotational torque applied to the tubing string through the operation of the pump is transferred to the second portion of the housing; and, (ii) controlling the rotation of the second portion together with the tubing string connected thereto relative to the first portion of the housing when the rotational torque is supplied to the second portion through the operation of the pump.

28. The method as recited in claim 27, wherein:

(i) step (ii) in claim 27 is performed such that such that rotation of the second portion is slower than the rotation of a rotor of the pump.

29. A tubing string rotator for controlling rotation of a tubing string, in a well, connected to a downhole pump, the tubing string rotator comprising:

(i) a housing having a first portion and a second portion, said second portion rotatable relative to said first portion, at least said second portion of said housing adapted to be operatively connected to the end of a length of the tubing string such that rotational torque applied to the tubing string through the operation of the pump is transferred to said second portion of said housing; and, (ii) means to permit the controlled rotation of said second portion of said housing, together with the tubing string connected thereto, relative to said first portion of said housing when a force generated from operation of the pump is supplied to the tubing string.

* * * * *